United States Patent [19]

Schwartz

[11] 4,324,223

[45] Apr. 13, 1982

[54] STOVE DOOR CONSTRUCTION

[75] Inventor: Larry A. Schwartz, Warwick, R.I.

[73] Assignee: Franklin Industries, Inc., Warwick, R.I.

[21] Appl. No.: 221,382

[22] Filed: Dec. 30, 1980

[51] Int. Cl.[3] ..... F23M 7/00

[52] U.S. Cl. ..... 126/200; 126/190

[58] Field of Search ..... 126/9 B, 9 R, 190, 200, 126/138; 110/173 R

[56] References Cited

U.S. PATENT DOCUMENTS 1,973,171 9/1934 Jacobs ..... 126/200

2,157,413 5/1939 Howard ..... 126/200

3,996,710 12/1976 Nuss ..... 126/260

*Primary Examiner*—Samuel Scott

*Assistant Examiner*—G. Anderson

*Attorney, Agent, or Firm*—Salter & Michaelson

[57] ABSTRACT

A convertible door for wood stoves and the like having a central opening therein. A pair of interchangeable panels are provided which are dimensioned to substantially cover said opening; one of said panels being opaque, the other being transparent. Each of the panels is detachably mountable on the rear surface of the door to thereby provide selectively opaque or transparent covers for said opening.

1 Claim, 5 Drawing Figures

FIG. 1
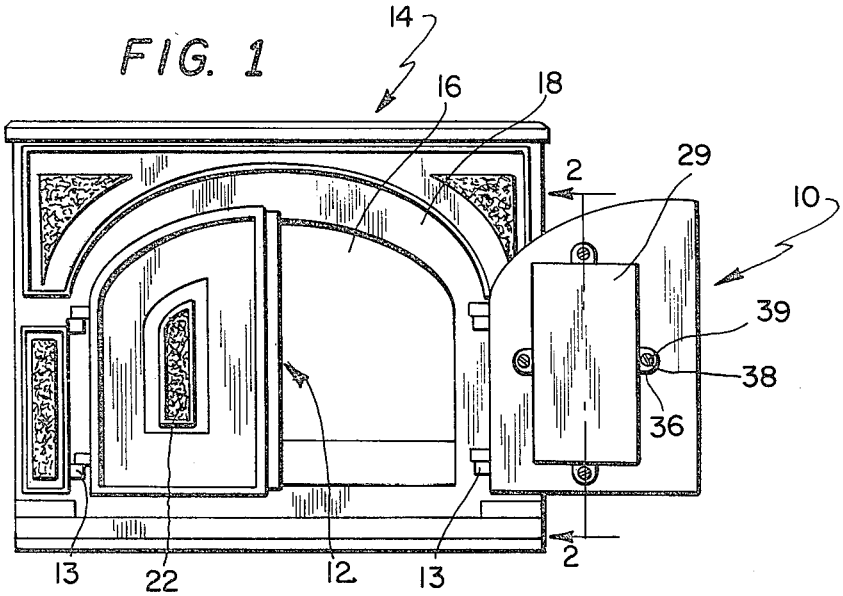
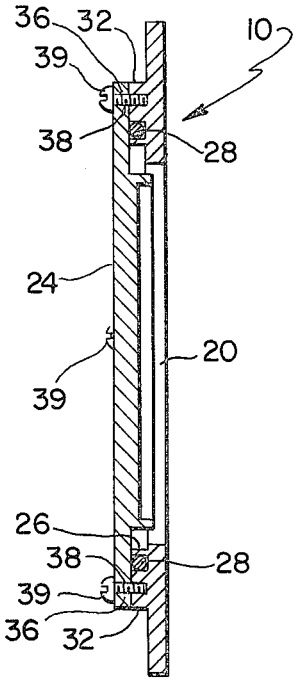
FIG. 2
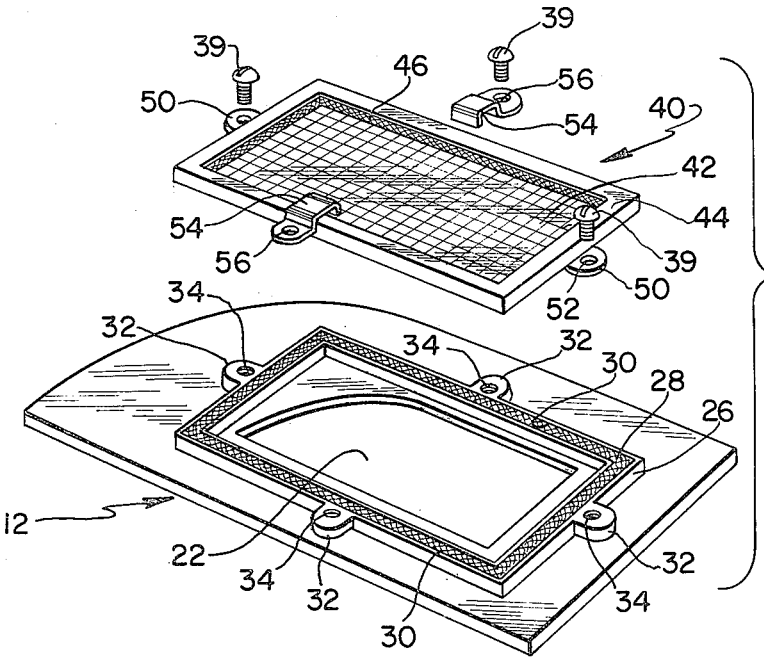
FIG. 3
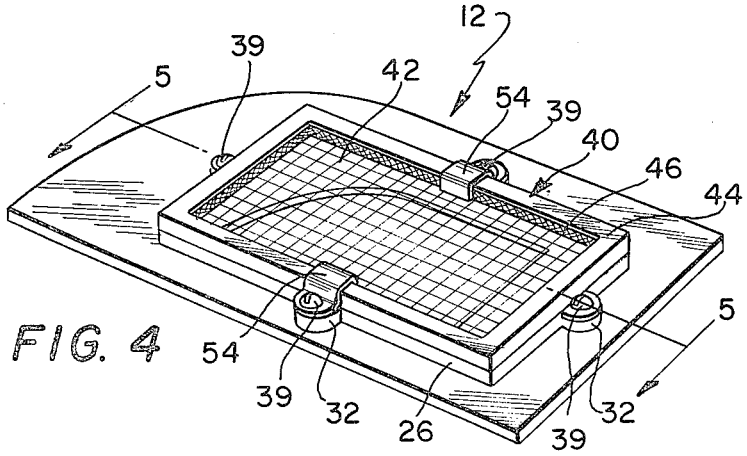
FIG. 4
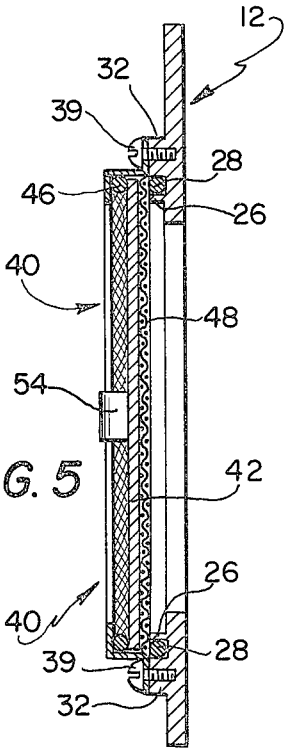
FIG. 5

STOVE DOOR CONSTRUCTION

BACKGROUND AND SUMMARY OF THE INVENTION

The instant invention relates to doors for wood burning stoves and the like and more particularly to glass panelled doors.

As a result of recent shortages in supplies in the world's oil markets and the rather drastic accompanying increases in oil prices many people have been turning to alternate energy sources to heat their homes. One of the most abundant alternate energy sources readily available is wood and consequently people are installing wood burning stoves in their homes in increasing numbers.

Wood burning stoves may not be as aesthetically desirable as fireplaces, but they are vastly more efficient than fireplaces for producing heat from wood, and as a result many people have foregone the use of their fireplaces to install wood burning stoves. Airtight wood burning stoves are generally the most efficient stoves available since they allow a user to control the amount of oxygen or air available to the fire to thereby control the combustion within the stove. Unfortunately, to properly effect the air-tight characteristics of stoves of this nature, the stoves must be fairly well sealed and cannot have openings for viewing the fire; and, as a result, they may not be as aesthetically attractive as other types of stoves, such as Franklin stoves and the like. The instant invention overcomes this drawback by providing glass panelled doors for use in air-tight stoves. While the use of glass panelled doors on air-tight stoves is not entirely new, the instant invention nevertheless represents a substantial improvement in the art by providing convertible stove doors with interchangeable opaque and transparent panels. Depending on the particular stove application, the opaque panels or the somewhat more expensive transparent panels are alternatively secured to the inner sides of the doors to selectively provide for non-viewing or viewing of the flame within the stove. When the transparent panels are secured to the doors, the full aesthetic beauty of the flame within the stove may be appreciated by those in the surrounding area and in addition the burning characteristics of the flame may be easily checked without opening the doors. On the other hand, there will be some stove applications where the opaque door panels will be preferable. This would obviously be the case, for example, in certain commercial applications where the added expense of transparent panels wouldn't be justifiable or where the user simply would not wish to take the time to frequently clean the transparent panels.

There are also certain obvious advantages from a manufacturing standpoint in providing a stove door which is adaptable for various applications. It is certainly more efficient and more economical to manufacture and distribute a stove door that is universally adaptable for various applications than it is to manufacture and distribute two separate and distinct types of doors, and therefore, the stove door of the instant invention represents an improvement from a manufacturing standpoint as well as from a consumer standpoint.

Accordingly, it is an object of the instant invention to provide a stove door with interchangeable opaque and transparent panels.

It is another object of the instant invention to provide a stove door which is adaptable for various applications.

It is a still further object of the instant invention to provide a universally adaptable stove door to provide increased manufacturing efficiency.

Another object is the provision of novel and unique means for easily and effectively mounting the interchangeable panels on the stove door.

Other objects, features and advantages of the invention shall become apparent as the description thereof proceeds when considered in connection with the accompanying illustrative drawing.

DESCRIPTION OF THE DRAWINGS

In the drawing which illustrates the best mode presently contemplated for carrying out the present invention:

FIG. 1 is a front elevational view of a woodburning stove with a pair of the stove doors of the instant invention mounted thereon;

FIG. 2 is an enlarged side sectional view of one of the stove doors taken along line 2—2 in FIG. 1;

FIG. 3 is an exploded perspective view of a glass panelled stove door of the instant invention;

FIG. 4 is a perspective view of a fully assembled glass panelled stove door of the instant invention; and FIG. 5 is an enlarged side sectional view thereof taken along line 5—5 of FIG. 4.

DESCRIPTION OF THE INVENTION

Referring now to the drawing, two of the stove doors of the instant invention are illustrated in FIG. 1 and are shown generally at 10 and 12. As may be noted, the doors 10 and 12 are a matched pair of doors and are shown pivotally mounted as at 13 on the front of a woodburning stove generally indicated at 14. The stove 14 is a conventional woodburning stove preferably made of cast iron or steel although it is understood that it may be made of any other suitable structural material. An access opening 16 is provided on the front of the stove 14 and is defined by an arch shaped frame 18 which extends substantially therearound, with the doors 10 and 12 being pivotally mounted on the frame 18 on opposite sides of the opening 16. As will be noted, the doors 10 and 12 are dimensioned so that when they are pivoted inwardly to a closed position they meet substantially along the vertical center line of the opening 16, conforming as a pair to substantially the configuration of said opening to provide a front cover therefor. It will be noted further that the peripheral dimensions of the doors 10 and 12 are somewhat greater than the interior dimensions of the opening 16 so that when the doors 10 and 12 are pivoted to a closed position, the peripheral portions of the rear surfaces thereof abut the forward surface of the frame 18 providing a seal around the opening 16. It is understood that while the doors herein disclosed are shown as a matched pair covering a substantially arch-shaped opening, they may be made in various other configurations to fit stoves of other designs and need not be used in pairs.

The stove doors 10 and 12 of the instant invention as embodied with the opaque panels 24 mounted thereon are shown in FIGS. 1 and 2. As may be noted, openings 20 and 22 are provided in the doors 10 and 12 respectively with the openings 20 and 22 each being of substantially the same configuration as their respective doors although they are obviously of substantially smaller peripheral dimensions than the doors, each of the openings 20 and 22 being covered with a substantially rectangular opaque panel 24. Preferably the doors 10 and 12 and the panels 24 are made from cast iron or steel although they may be made from other suitable materials as desired.

As will be noted particularly from FIGS. 2 and 3, in order to mount the panels 24 on each of the doors 10 and 12, a raised boss 26 of substantially rectangular configuration is formed on each of the rear surfaces thereof extending substantially around the openings 20 and 22. Boss 26 has therein a rearwardly facing channel 30 containing a gasket 28 made of a suitable heat resistant gasket material. A plurality of mounting posts 32 with threaded openings 34 therein are provided around the periphery of the boss 26, and as will be noted from FIGS. 1 and 2, a plurality of mounting tabs 36 with openings 38 therein are integrally provided extending outwardly from the periphery of the panel 24 in registry with posts 32. The panels 24 are secured to the doors 10 and 12 as shown in FIGS. 1 and 2 with a plurality of screws or bolts 39 which extend through the openings 36 in the panels 24 and which are received in threaded engagement in the openings 34 in the mounting posts 32. As will be further noted, as the bolts 39 are received in the openings 34 to secure the panels 24 to the doors 10 and 12, the front surfaces of the panels 24 engage the gaskets 28 thereby providing cushioned seals between the panels 24 and the bosses 26.

The convertible stove door 12 of the instant invention with a transparent panel 40 covering the opening 22 is shown in FIGS. 3 through 5. As will be noted, the panel 40 has a central transparent plate 42 which is preferably made of a heat resistant glass and a rigid peripheral frame 44 which is preferably made of steel or a steel alloy. It is understood that other structural materials for the frame 44 and the plate 42 are available and may be substituted as desired. A gasket 46 made of a heat resistant gasket material is provided between the frame 44 and the transparent plate 42 to provide a cushioned seal therebetween and a metallic wire screen 48 is provided overlaying the front surface of the transparent plate 42 as a safety measure in the event of the breakage thereof. A pair of tabs 50 with openings 52 therein extend outwardly from opposite ends of the frame 44 for securing the panel 40 to the door 12. In addition a pair of clamping brackets 54, each having openings 56 therein, are provided engaging the frame 44 and thereby clamping the panel 40 to further secure it to the door 12. A plurality of mounting screws or bolts 39 are again provided to secure the panel 40 to the door 12 with the screws or bolts 39 extending through the openings 52 and 56 in the tabs 50 and the clamps 54 and being received in threaded engagement in openings 34 in the mounting posts 32. As the bolts 39 are received in the opening 34, the gasket 28 engages the panel 40 providing a cushioned seal between the front surface of the transparent plate 42 and the boss 26 with the screen 48 being sandwiched therebetween.

It is obvious, therefore, that the instant invention as herein disclosed provides an easily convertible door for various modes of stove operation. The door as shown with the raised boss 26, the channel 30 and the gasket 28 is easily adaptable for use with either transparent or opaque panels to permit viewing or non-viewing of the flame as desired. The panels may be quickly and easily interchanged to selectively convert the stove doors for various applications providing obvious advantages for both manufacturers and users.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A door for wood burning stoves and the like comprising a. a metallic door having a central opening therein;

b. a raised channeled boss formed on the rear side of said door spaced from said opening and extending substantially therearound;

c. a gasket positioned substantially within said channel and extending substantially around said opening;

d. a plurality of raised mounting posts formed on the rear side of said door adjacent to said boss and spaced around the periphery thereof, each of said posts being raised from the rear surface of said door substantially the same amount as said boss and each having threaded central openings therein;

e. a transparent panel of substantially the same peripheral dimension and configuration as said boss positioned in pressurized engagement with said gasket thereby effecting a cushioned seal between said panel and said boss;

f. a plurality of tabs extending outwardly from the periphery of said panel and positioned therearound to correspond to the positions of at least a portion of said posts around said boss, each of said tabs having central openings therein; and g. a plurality of bolt means extending through said openings in said tabs and being received in at least a portion of said openings in said posts in threaded engagement therewith to thereby secure said panel to said door.

* * * * *